US005922247A

United States Patent [19]

Shoham et al.

[11] Patent Number: 5,922,247

[45] Date of Patent: Jul. 13, 1999

[54] ULTRASONIC DEVICE FOR ATOMIZING LIQUIDS

[75] Inventors: Yacov Shoham; Zeev Rosner, both of Kibbutz Netzer Sereni; Alex Riftin, Ashdod; Eli Gorenstein, Savyon, all of Israel

[73] Assignee: Green Clouds Ltd., Savyon, Israel

[21] Appl. No.: 08/907,459

[22] Filed: Aug. 8, 1997

[51] Int. Cl.[6] ..... B01F 3/04

[52] U.S. Cl. ..... 261/78.2; 96/355; 96/389; 239/102.2; 261/DIG. 48

[58] Field of Search ..... 261/78.1, 78.2, 261/DIG. 48; 239/102.1, 102.2; 96/355, 240, 389; 95/29, 216, 217

[56] References Cited

U.S. PATENT DOCUMENTS

| | | | |
|---|---|---|---|
| 3,539,102 | 11/1970 | Lang | 261/DIG. 48 |
| 3,788,543 | 1/1974 | St. Amand et al. | 261/DIG. 48 |
| 3,893,623 | 7/1975 | Toupin | 239/102.2 |
| 3,901,443 | 8/1975 | Mitsui et al. | 261/DIG. 48 |
| 4,031,171 | 6/1977 | Asaso et al. | 261/DIG. 48 |
| 4,251,241 | 2/1981 | Bothun | 261/78.2 |
| 4,257,989 | 3/1981 | Nishikawa | 261/DIG. 48 |
| 4,641,053 | 2/1987 | Takeda | 239/102.2 |
| 5,176,856 | 1/1993 | Takahashi et al. | 261/DIG. 48 |
| 5,300,260 | 4/1994 | Keshet et al. | 261/DIG. 48 |
| 5,529,753 | 6/1996 | Haddad et al. | 239/102.2 |
| 5,588,592 | 12/1996 | Wilson | 239/102.2 |

FOREIGN PATENT DOCUMENTS

| | | | |
|---|---|---|---|
| 54-68041 | 5/1979 | Japan | 261/DIG. 48 |
| 3-30811 | 2/1991 | Japan | 261/78.2 |
| 1524934 | 11/1989 | Russian Federation | 261/78.2 |

*Primary Examiner*—Duane S. Smith
*Attorney, Agent, or Firm*—Lowe Hauptman Gopstein Gilman & Berner

[57] ABSTRACT

An ultrasonic device for atomizing liquids has at least one atomization unit wherein an upward directed ultrasonic transducer is located at the bottom of the unit with the top of the unit being open. A reservoir is connected to the unit and a minimum liquid level is maintained in each unit during atomization. An electric supply is connected to the transducer and liquid is circulated from the reservoir, across each transducer, and back to the reservoir for removal of impurities.

10 Claims, 3 Drawing Sheets

ULTRASONIC DEVICE FOR ATOMIZING LIQUIDS

FIELD OF THE INVENTION

The present invention generally relates to an ultrasonic device for atomizing liquids. More specifically, the present invention relates to an ultrasonic device for atomizing liquids having at least one atomization unit and characterized by having a reservoir connected to all of the units, means for maintaining the liquid level in each unit, a high frequency electric supply connected to each transducer, and means for circulating (accelerating) the liquid from the reservoir, across each transducer, and back to the reservoir.

BACKGROUND OF THE INVENTION

The standard ultrasonic device for atomizing liquids is normally comprised of a single atomization unit wherein an upward directed liquid covered ultrasonic transducer is located at the bottom of the unit and the top of the unit is open (covered by a gas). These known devices have numerous operational problems which prevent them from being used in many applications. These problems exist because each element of the standard known device presents specific operational limitations.

First, ultrasonic transducer will almost instantaneously thermally overheat if exposed to air (or gas) during operation. Movement of the standard devices may result in tipping of the liquid level above the transducer such that the transducer may become exposed to air or gas. Placing of a sufficient (taller) column of liquid above the transducer may help to solve the device mobility problem, but it adversely affects the operational efficiency of the transducers.

Second, the vibrating surface of the ultrasonic transducer is adversely affected by accumulated precipitates and impurity coatings (deposits) caused by the liquid environment. These coatings often deteriorate transducer efficiency and create a thermal insulation layer which eventually results in the transducer thermally overheating.

Impurities in liquids have many sources. Often impurities may be initially present in the liquids. Impurities may enter into the liquid through contact with the air (or gas). Sometimes impurities are a result of interactions between the liquid and components of the device (e.g. pumps, gaskets, etc.). Furthermore impurities may be produced by the interaction process with the transducer (e.g. from the ultrasonic waves, chemical interactions, or electrolysis). These impurities often aggregate, and further contribute to the accumulation of coatings (deposits) on the transducers.

Third, use of multiple transducers within the same atomization unit (to increase the atomization rate and output) results in liquid turbulence affects on the transducers (including destructive electrical etching phenomena).

The device of the present invention overcomes the above mentioned disadvantages, allows device location transfer (without risking transducer exposure), and prevents impurity accumulation.

Furthermore, most known atomization devices produce a broad statistical distribution of droplet sizes. This has disadvantages in applications requiring ultra-accurate delivery systems (e.g. medicines, disinfectants, fungicides, etc.). One embodiment of the device of the present invention is especially for allowing production of a narrow statistical distribution of about 0.5 to 5.0 micron diameter droplets.

SUMMARY OF THE INVENTION

The present invention relates to an ultrasonic device for atomizing liquids. This device is comprised of at least one atomization unit (wherein an approximately upward directed ultrasonic transducer is located at the bottom of each unit and the top of each unit is open (covered by gas), and is characterized by a reservoir connected to all of the units, means for maintaining a minimum liquid level in each unit during atomization, a high frequency electric supply connected to each transducer, and means for circulating the liquid (to be atomized) through the reservoir, across each transducer, and back to the reservoir.

In the context of the present invention, a "transducer" relates to any immersed transducer, mechanical component, electrical component, or electronic component whereby vibrations of above 800 KHz result in the production of droplets, or in the atomization of the immersion liquid, or in the production of an aerosol. Furthermore, in the context of the present invention, an "upward directed" ultrasonic transducer relates to the essential trajectory direction of the resultant droplets, atomization, or aerosol. In the context of the present invention "approximately upward" relates to small angle deviations from true upward, where these small angles are never null.

The present invention relates to an ultrasonic device for atomizing liquids, especially useful for producing a narrow statistical distribution of about 0.5 to 5.0 micron diameter droplets. This device contains at least one atomization unit wherein an approximately upward directed ultrasonic transducer is located at the bottom of each unit and the top of each unit is open (covered by gas).

Benefits are derived by orienting the transducer into the approximately upward direction instead of a true (exact) upward direction. The primary benefit relates to the return trajectory of escaping heavy droplets. These heavy droplets do not have sufficient momentum to continue indefinitely in an upward (airborne) direction, and thus fall back on the liquid in the unit. When the transducer is oriented exactly upwards, the fall back trajectory of the heavy droplets returns the droplets directly back to the area of the liquid surface from where transducer pressured droplets emerge. This fall back temporarily interferes with the emergence of new droplets, thus adversely effecting the efficiency of aerosol particle production (atomization).

When the transducer is oriented in the approximately upward direction (slightly skew), the fall back trajectory of the heavy droplets is not identical to the emergence trajectory of these same particles Thus the efficiency of the transducer is only affected by nominal losses associated with the oblique angle of approximately upward.

Embodiments of the device of the present invention have from one atomization unit to about 100 atomization units. The preferred embodiment of the device of the present invention has from about 12 to about 36 atomization units.

In the context of the present invention "pipes" relate to tubes, ducts, conduits, tunnels, passages, or the like.

The device of the present invention is characterized by a reservoir connected to all of the units by pipes, means for maintaining a minimum liquid level in each unit during atomization, a high frequency electric supply connected to each transducer, and means for circulating the liquid to be atomized through the reservoir and through the pipes and across each transducer.

According to the preferred embodiment of the device of the present invention, the operational frequency range of the electricity supplied to the transducers is above 800 KHz. This frequency range has been found to be much more effective for the production of ultra-small aerosol atomization droplets (0.5 to 5.0 micron diameter).

Transducer operating life is dependent on the minimization of accumulated impurity and precipitate buildup on it's vibrating surface. These impurities and precipitates may also be caused by operational interactions between the transducer and the liquid. The primary mechanism of the present invention for preventing the accumulation of coatings (deposits) on the transducer surface is by circulating the liquid across each transducer (preventing impurities from settling on the transducer).

In the preferred embodiment of the device of the present invention, floating impurities, settling impurities, precipitates, or filterable impurities are removed from the liquid at the reservoir. The choice of which type or how many types of impurities (or precipitates) are removed (and also their method of removal) is functionally determined according to the nature of the liquid being atomized.

The physical adsorption and adhesion properties of liquid borne impurities (residues) and precipitates are strongly dependent on the flow rate of the liquid. Insolubility, settling and floating processes are optimal in sedentary reservoirs (having no traversing liquids).

Operationally, in the preferred embodiment of the device of the present invention, the reservoir is divided into two sections such that any liquid (passing from a unit and through the reservoir) passes through both sections, and such that the flow rates of the liquid entering each section are different. The use of two liquid velocities at different speeds improves the impurity and precipitate removal processes by allowing each process to be performed in the reservoir section most appropriate.

There are many possible means for maintaining a minimum liquid level in each unit during atomization. These means include the use of liquid level sensors (e.g. floats, electrodes, etc.) and controlled refilling liquid flow valves for each unit.

According to the preferred embodiment of the device of the present invention, the means for maintaining a minimum liquid level in each unit during atomization is comprised of the plurality of units having aligned heights with the reservoir (such that a maintained liquid level in the reservoir provides a predetermined liquid level in the units), and maintaining the liquid level in the reservoir by a inlet valve controlled by a liquid level sensor (such that lowering of the liquid level in the reservoir activates the sensor which in turn causes the valve to open whereby additional liquid is added to the reservoir until the reservoir liquid level is restored).

In the context of the present invention "aligned heights" relates to the equalization of the hydrostatic pressure between the reservoir and the units. This equalization may be performed either by physically matching the liquid levels at the same elevation, or by using a pump to compensate for differences in elevation.

According to the preferred embodiment of the device of the present invention, the electric supply connected to each transducer has a sensor connected to the electric supply. This sensor is for automatically turning off the electric supply whenever it is detected that the liquid level in the reservoir is below a predetermined height.

Furthermore, the electric supply connected to each transducer has a sensor connected to the electric supply. This sensor is for automatically turning off the electric supply whenever the sensor detects that the angle of the reservoir surface is outside predetermined limits.

Another feature of the preferred embodiment of the device of the present invention is an inertia separation cyclone (for removing droplets greater than about 5.0 micron diameter from the produced (atomized) vapor). This cyclone (feature) is comprised of a common vapor chamber attached to the top of all of the atomization units, an air pump attached to the chamber (for continuously providing a supply of high velocity air (or gas) into and through the chamber), and an open topped vertical cylinder or cone connected to the chamber (such that the air (or gas) and the vapor in the chamber tangentially enters into the bottom of the cylinder or cone).

Operationally, the droplets in the produced vapor are carried away from the top of the atomization units by the high velocity air (or gas). When these droplets enter into the spiral path in the cylinder (or cone), the heavier (larger) droplets collide with the cylinder (or cone) and fall back along the cyclone wall (for eventual return to the reservoir).

BRIEF DESCRIPTION OF THE DRAWING

The present invention will be further described by FIGS. 1 through 3. These figures are solely intended to illustrate and clarify in detail selected embodiments of the invention and are not intended to limit the scope of the invention in any manner.

DETAILED DESCRIPTION OF THE INVENTION

Figure 1:
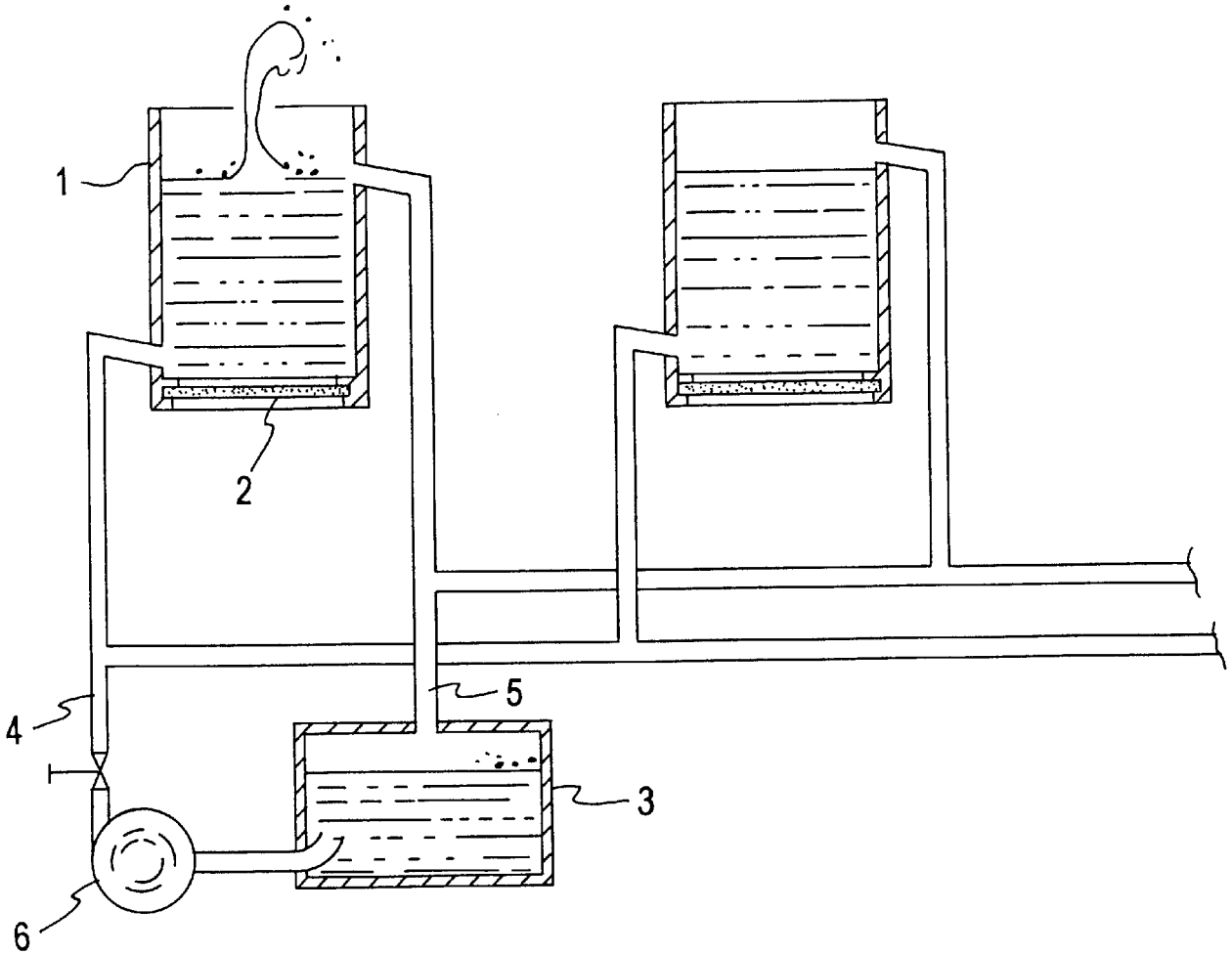
FIG. 1 illustrates a profile cross section view of a liquid circulation path through a partial device of a basic embodiment type.

FIG. 1 illustrates a profile cross section view of a liquid circulation path through a partial device of a basic embodiment type. Parts of an ultrasonic device for atomizing liquids are shown, including a plurality of atomization units (1) wherein an approximately upward directed ultrasonic transducer (2) is located at the bottom of each unit and the top of each unit is open (covered by gas), and characterized by a reservoir (3) connected to all of the units by pipes (4) (5), and a pump (6) for circulating the liquid to be atomized through the reservoir and through the pipes and across each transducer.

Operationally, liquid is pumped from the central region of the reservoir (where both floating and settling impurities are minimum) through the liquid dispersion pipe (4). This pumped liquid is directed in each unit across the surface of each transducer. The kinetic energy of this pumped liquid minimizes settling type impurities from resting on the transducer These settling type impurities are carried away with the flowing liquid's current. The floating type impurities simultaneously rise to the surface of the liquid.

Figure 2:
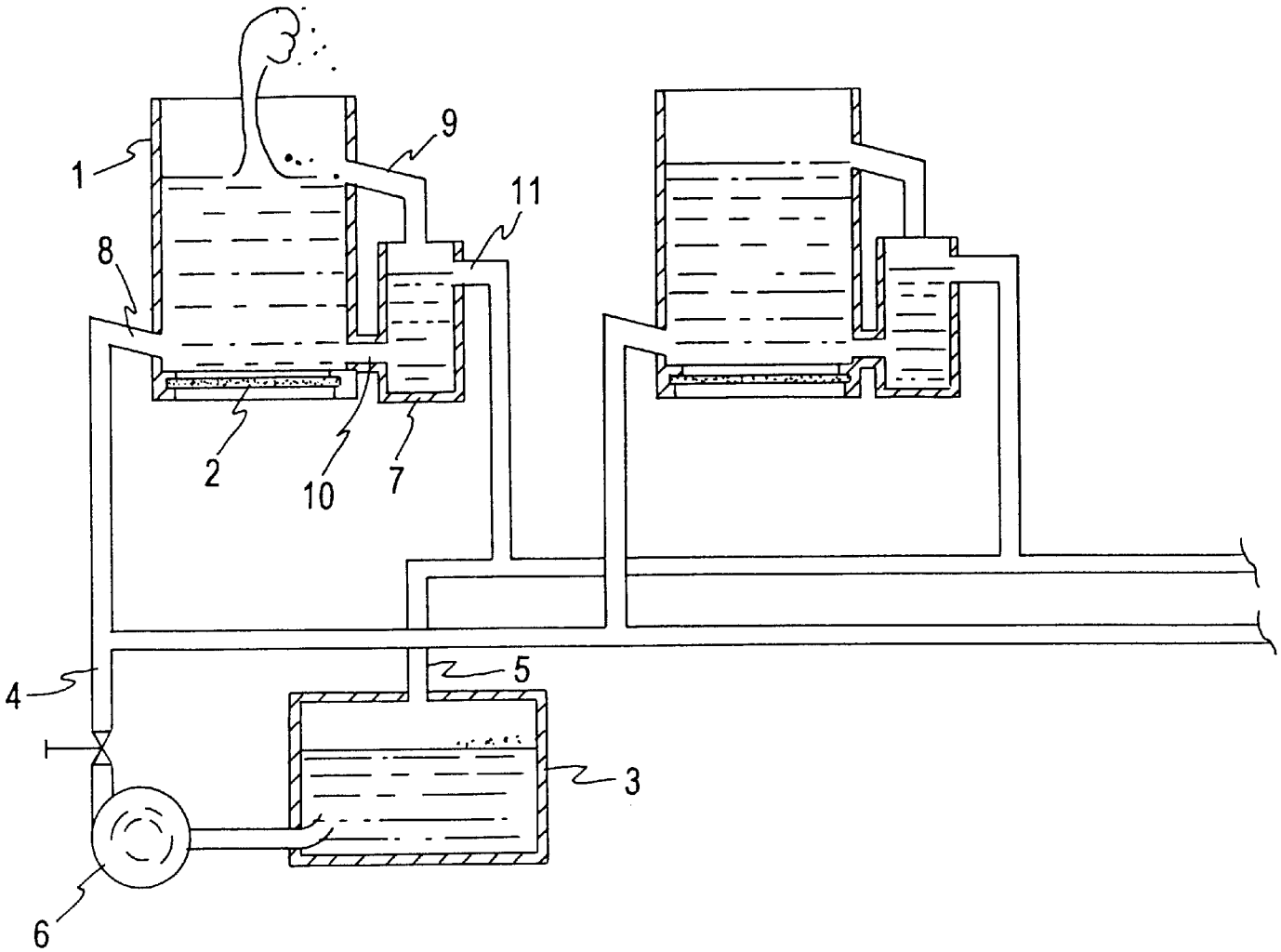
FIG. 2 illustrates a profile cross section view of a liquid circulation path through a partial device of the preferred embodiment type.

Defining the surface of the liquid (in each unit) is a liquid overflow pipe (5) outlet. The overflow liquid carries both the floating type impurities and those settling type impurities which have been carried this far in the flowing liquid's current. This overflow liquid completes the circulation by returning to the reservoir Thus impurities tend to concentrate in the reservoir rather than in the unit or on the transducer FIG. 2 illustrates a profile cross section view of a liquid circulation path through a partial device of the preferred embodiment type. Parts of an ultrasonic device for atomizing liquids are shown, including a plurality of atomization units (1) wherein an approximately upward directed ultrasonic transducer (2) is located at the bottom of each unit and the top of each unit is open (covered by gas), and characterized by a reservoir (3) (7) connected to all of the units by pipes (4) (5), and a pump (6) for circulating the liquid to be atomized through the reservoir and through the pipes and across each transducer.

Each unit contains a liquid inlet (back flow preventing) orifice (8) which directs the pumped liquid at the transducer's surface, a surface overflow outlet (9) for draining floating type impurities, and a bottom outlet (10) for draining settlement type impurities. Orifice (8) has a much larger diameter than orifice (10).

Functionally, the reservoir is divided into two sections such that any liquid (passing from a unit and through the reservoir) passes through both sections, and such that the velocities of the liquid entering each section are different. Here the reservoir is divided into a common reservoir section (3) and a unit specific reservoir section (7).

The unit specific reservoir section contains two inlets being the extension of the outlets (9) (10) from the unit, and an outlet (11) to the common reservoir section. Functionally the unit specific reservoir serves as a means for maintaining a minimum liquid level in each unit during atomization, when seen in conjunction with unit inlet orifice (8). This minimum liquid level is at the height of outlet (11) with respect to the unit. Furthermore, failure of new liquid to enter into the unit through orifice (8) results in a back flow of liquid from reservoir section (7) through orifice (10) into unit (1).

Figure 3:
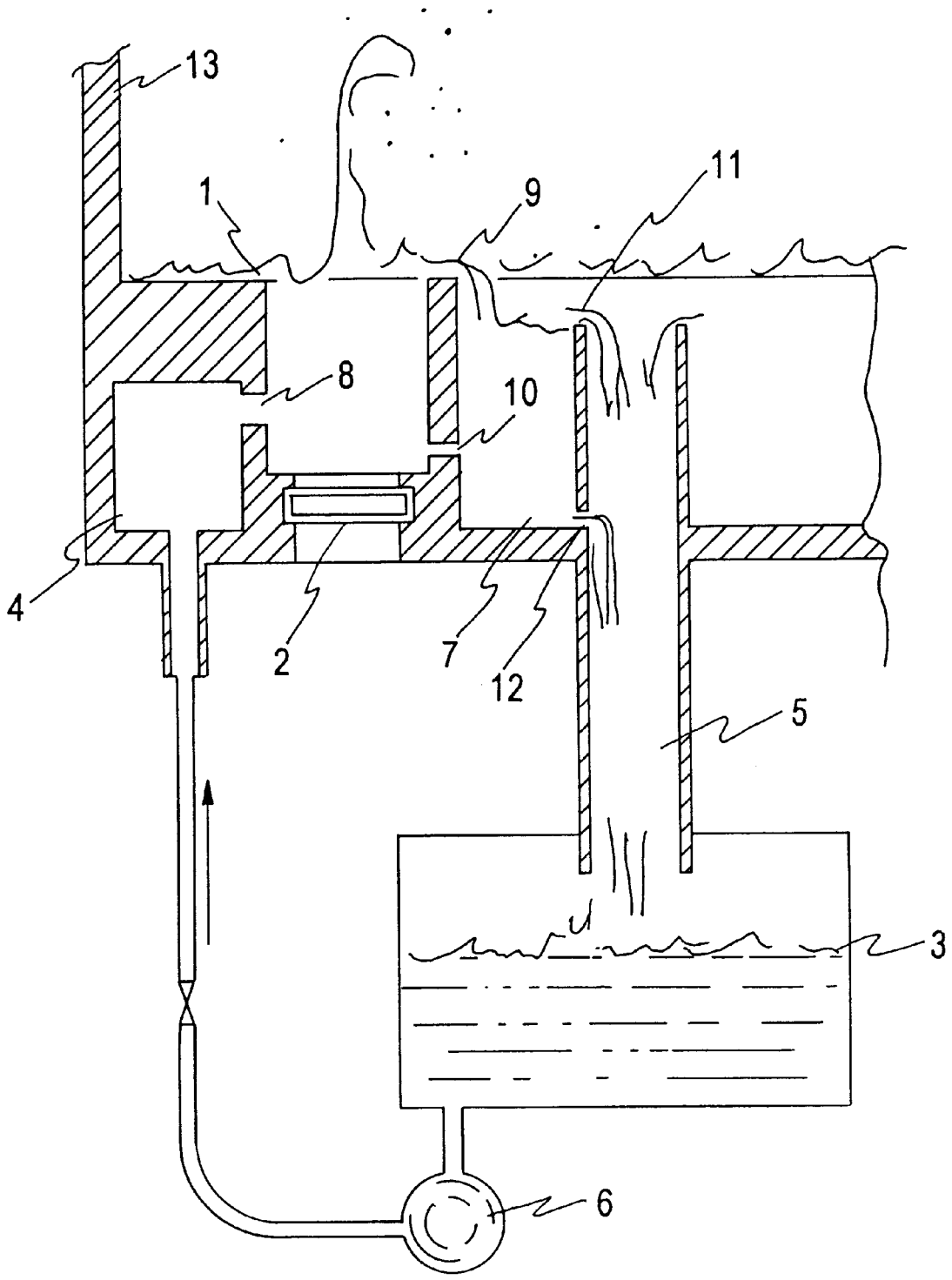
FIG. 3 illustrates a profile cross section view of a liquid circulation path through another partial device of the preferred embodiment type.

FIG. 3 illustrates a profile cross section view of a liquid circulation path through another partial device of the preferred embodiment type. Parts of an ultrasonic device for atomizing liquids are shown, including one of a plurality of atomization units (1) wherein an approximately upward directed ultrasonic transducer (2) is located at the bottom of the unit and the top of the unit is open (covered by gas), and characterized by a reservoir (3) (7) connected to all of the units by pipes (4) (5), and a pump (6) for circulating the liquid to be atomized through the reservoir and through the pipes and across each transducer.

The unit contains a liquid inlet (back flow preventing) orifice (8) which directs the pumped liquid at the transducer's surface, a surface overflow outlet (9) for draining floating type impurities, and a bottom outlet (10) for draining settlement type impurities The diameter of orifice (8) is much larger than the diameter of orifice (10).

Functionally, the reservoir is divided into two sections such that any liquid (passing from a unit and through the reservoir) passes through both sections, and such that the velocities of the liquid entering each section are different. Here the reservoir is divided into a common reservoir section (3) and a unit specific reservoir section (7).

The unit specific reservoir section contains two inlets being the extension of the outlets (9) (10) from the unit, and two outlets (11) (12) to the common reservoir section. Outlet (12) is of very small diameter, and only effects the liquid level in reservoir section (7) when the device of the present invention is turned off for a long time—whereby most of the residual liquid in the unit will drain to the common reservoir (3).

Functionally the upper outlet (11) serves as a means for maintaining a minimum liquid level in each unit during atomization, even when seen in conjunction with similar upper outlets for other units (not shown) which share the common upper overflow wall (13). This minimum liquid level is at the height of outlet (11) with respect to the unit. The common upper overflow wall is around all or part of the plurality of atomizing units. Thus all of the atomizing units sharing a common upper overflow wall are effectively operating in a common liquid reservoir whenever the overflow condition from some of these units is occurring. In the unit, failure of new liquid to enter will result in liquid in the reservoir section (7) back flowing through outlet (10) into the unit.

We claim:

1. An ultrasonic device for atomizing liquids, comprising at least one atomization unit including an approximately upward directed ultrasonic transducer located at the bottom of each unit and wherein the top of each unit is open, and a reservoir connected to said at least one unit, means for maintaining a minimum liquid level in said at least one unit during atomization, an electric supply connected to the transducer, and means for circulating the liquid from the reservoir, across the transducer, and back to the reservoir.

2. A device according to claim 1 wherein the operational frequency range of the electricity supplied to the transducers is above 800 KHz.

3. A device according to claim 1 further comprising an arrangement, connected to the reservoir, wherein floating impurities, settling impurities, precipitates, or filterable impurities are removed from the liquid at the reservoir.

4. A device according to claim 1 wherein the reservoir is divided into two sections such that any liquid passing from said at least one unit and through the reservoir passes through both sections, and such that the flow rates of said liquid entering each section are different.

5. A device according to claim 1 wherein the means for maintaining a minimum liquid level in said at least one unit during atomization is comprised of a plurality of said units having aligned heights with the reservoir such that a maintained liquid level in the reservoir provides a predetermined liquid level in the units, and the liquid level in the reservoir is maintained by an inlet valve controlled by a liquid level sensor, such that lowering of the liquid level in the reservoir activates said sensor which in turn causes said valve to open whereby additional liquid is added to the reservoir until said reservoir liquid level is restored.

6. A device according to claim 1 wherein the electric supply connected to the transducer has a sensor connected to the electric supply, said sensor automatically turning off the electric supply whenever it detects that the liquid level in the reservoir is below a predetermined height.

7. A device according to claim 1 wherein the electric supply connected to the transducer has a sensor connected to the electric supply, said sensor automatically turning off said electric supply whenever the sensor detects that the angle of liquid in the reservoir is outside of predetermined limits.

8. A device according to claim 1 having from about 12 to about 36 of said atomization units.

9. A device according to claim 1 having an inertia separation cyclone for removing droplets of greater than about 5.0 micron diameter from the produced vapor, comprising a common vapor chamber attached to the top of the atomization units, an air pump attached to said chamber for continuously providing a supply of high velocity air into and through said chamber, and an open topped vertical cylinder or cone connected to said chamber such that the air and vapor in said chamber tangentially enters into the bottom of the cylinder or cone.

10. An ultrasonic device for atomizing liquids, comprising at least one atomization unit including an approximately upward directed ultrasonic transducer located at a bottom of each unit and wherein a top of each unit is open, and a reservoir connected to said at least one unit, an arrangement connected to said unit to maintain a minimum liquid level in said unit during atomization, an electric supply connected to the transducer, and a circulatory arrangement connected to circulate liquid from the reservoir, across the transducer, and back to the reservoir.

* * * * *